United States Patent [19]

Kobayashi et al.

[11] 4,374,529

[45] Feb. 22, 1983

[54] COIN DISPENSING APPARATUS

[75] Inventors: Osamu Kobayashi; Masanori Tanaka, both of Sakato, Japan

[73] Assignee: Kabushiki Kaisha Nippon Coinco, Tokyo, Japan

[21] Appl. No.: 190,743

[22] Filed: Sep. 25, 1980

[30] Foreign Application Priority Data

Oct. 8, 1979 [JP] Japan ..... 54-139463[U]
Oct. 8, 1979 [JP] Japan ..... 54-139465[U]

[51] Int. Cl.[3] ..... G07D 1/02
[52] U.S. Cl. ..... 133/4 A; 221/11
[58] Field of Search ..... 133/2, 4 R, 4 A; 221/14, 18, 19, 11

[56] References Cited

U.S. PATENT DOCUMENTS 2,690,828 10/1954 Staiger ..... 133/4 R
3,080,035 3/1963 Diaz ..... 133/4 R

*Primary Examiner*—Stanley H. Tollberg
*Attorney, Agent, or Firm*—Spensley, Horn, Jubas & Lubitz

[57] ABSTRACT

A coin dispensing apparatus capable of selectively dispensing a coin of a predetermined denomination from among coins of various denominations stored in a coin tube assembly. The coin tube assembly is detachably mounted in a housing. At portion to the bottom of the tube assembly are provided both pay-out slide and coin base, whereby coins in the tube assembly are prevented from dropping out when the tube assembly is detached. Locking parts which are provided at the tube assembly and the housing are engaged with each other, in position. A coin level detector is disposed in the housing so that the detector can be set in position when the tube assembly is attached to the housing. The detector detects when the number of coins is reduced to a predetermined value.

9 Claims, 13 Drawing Figures

COIN DISPENSING APPARATUS

BACKGROUND OF THE INVENTION

This invention relate to coin dispensing apparatuses.

In one example of a conventional coin dispensing apparatus, a sector-shaped operating plate is disposed bellow two juxtaposed coin tubes, and the operating plate is turned by a drive motor so that a coin dispensing outlet is aligned with the coin tube from which coins should be dispensed, to allow the coins in the coin tube to be dispensed.

However, the operating plate cannot be used to dispense coins from more than two juxtaposed coin tubes. Accordingly, in the case of dispensing coins out of a number of juxtaposed coin tubes, it is necessary to provide one operating plate for every two coin tubes and to drive these operating plate individually. Accordingly, it is necessary to provide a number of drive motors, and accordingly its coin dispensing mechanism is intricate. Thus, it is rather difficult to assemble such a coin dispensing apparatus, and the manufactured apparatus is high in cost.

It may be difficult to provide a number of drive motors because of an available space, and accordingly the number of coin tubes is necessarily limited. If the number of coin tubes is small, then the number of pieces of coins contained in the coin tubes is also small, and accordingly a shortage of change is liable to occur. In addition, this construction cannot satisfactorily deal with the dispensation of coins in various denominations.

Furthermore, in the conventional coin dispensing apparatus, its coin tube is fixed thereto, and therefore it is considerably difficult to supply coins additionally when required. The inspection and maintenance of a coin dispensing mechanism disposed below the coin tube are so difficult that the inspection and maintenance are often disregarded. Therefore, for instance, dirty coins make movable parts of the apparatus unserviceable. As the coin tube is fixed to the dispensing apparatus as described above, in order to change the denominations of dispensing coins, it is necessary to change not only the coin tube but also the dispensing mechanism. Furthermore, in the inspection and maintenance of the dispensing apparatus, it is necessary to remove the coins in the coin tube one at a time by operating the dispensing apparatus before the coin tube is disassembled from the apparatus. This is undoubtedly troublesome.

A coin dispensing apparatus used with an automatic vender is provided with a change dispensing tube. When the number of coins in the tube is reduced to a predetermined value, then coins are supplied into the change dispensing tube from an auxiliary coin tube. In such a coin dispensing apparatus, the detection of the number of coins in the coin tube is carried out as follows: An empty detector is provided at a predetermined position on the coin tube or at a predetermined position on the coin tube receiving compartment of the dispensing apparatus, to detect the number of coins in the coin tube.

However, in the case where the empty detector is provided on the coin tube as described above, the removal of the coin tube for inspection and maintenance is difficult because of the wiring extended to the apparatus body. In the case where the empty detector is provided on the coin tube receiving compartment of the apparatus body, a coin tube which can be detachably mounted in the compartment cannot snugly mounted therein because of its construction. Accordingly, it is difficult to bring the empty detector into close contact with the coin tube, with the result that the number of coins in the coin tube is often detected with errors.

SUMMARY OF THE INVENTION

Accordingly, an object of this invention is to provide a coin dispensing apparatus which comprise a cassette type coin tube assembly which is made up of a plurality of juxtaposed coin tubes, a coin base spaced from the bottom of the coin tube assembly with a predetermined gap therebetween, a coin dispensing slide plate disposed in the gap, and locking parts on its sides, so that it can be readily achieved to additionally supply coins into the coin tubes and to remove the remaining coins in the coin tubes, the inspection and maintenance can be readily accomplished, and the coins can be dispensed readily according to the denominations by the preparation of auxiliary coin tube assemblies according to the coin diameters.

Another object of the invention is to provide a coin dispensing apparatus which comprises: an empty detector, or coin level detector, which is provided on the wall of the coin tube receiving compartment of the apparatus body in such a manner that it is rockable in a vertical plane by spring means and its front end appears in the compartment; and a cassette type coin tube assembly which can be detachably mounted in the compartment in such a manner that the coin level detector is positively brought into close contact with a coin tube which is a part of the cassette type coin tube assembly, whereby the number of coins in the coin tube can be detected at all times.

A further object of the invention is to provide a coin dispensing apparatus in which a cassette type coin tube assembly is provided with a pay-out slide which simultaneously takes the bottom coins in coin tubes forming the coin tube assembly and simultaneously return them to the coin tubes, the coins delivered by the pay-out slide are selectively dispensed according to the amounts of change and the denominations, all the bottom coins in the coin tubes are moved for every coin dispensing operation and the coins stacked in the coin tubes are slidably moved or the coins delivered by the pay-out slide are moved slidably on a coin base supporting the stacks of coins in the coin tubes so as to prevent the coins in the coin tubes from being stuck to one another and to make it possible to readily clean a coin dispensing mechanism below the coin tube assembly, whereby the coin dispensing apparatus is operated under the best conditions at all times.

The foregoing objects and other objects as well as the characteristic features of the present invention will become more apparent from the following detailed description and the appended claims when read in conjunction with the accompanying drawings, in which like parts are designated by like reference characters.

BRIEF DESCRIPTION OF THE INVENTION

Figure 2:
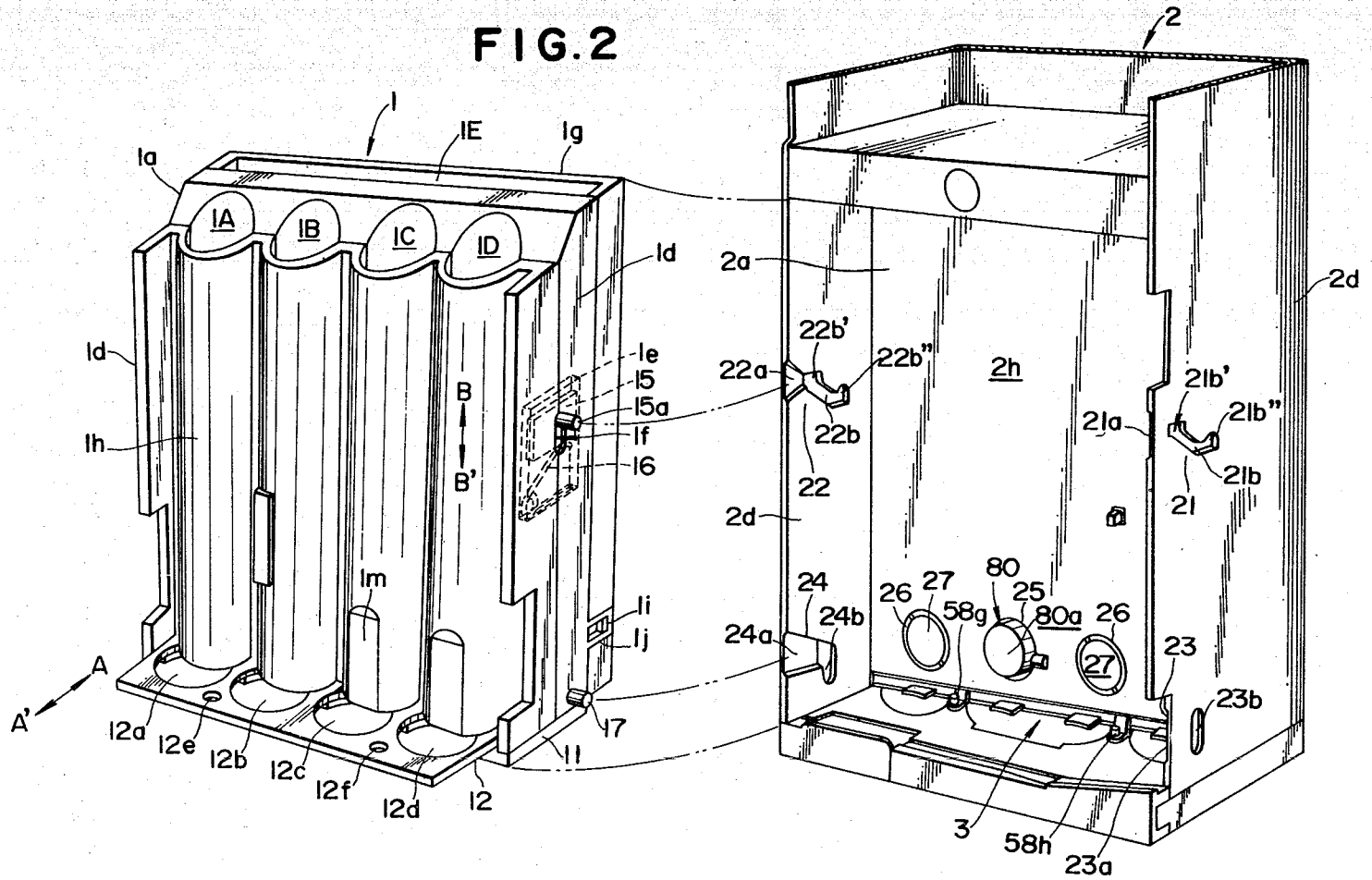
FIG. 2 is a perspective view of one example of the cassette type coin tube assembly and a coin tube receiving compartment in the coin dispensing apparatus according to the invention.
Figure 7:
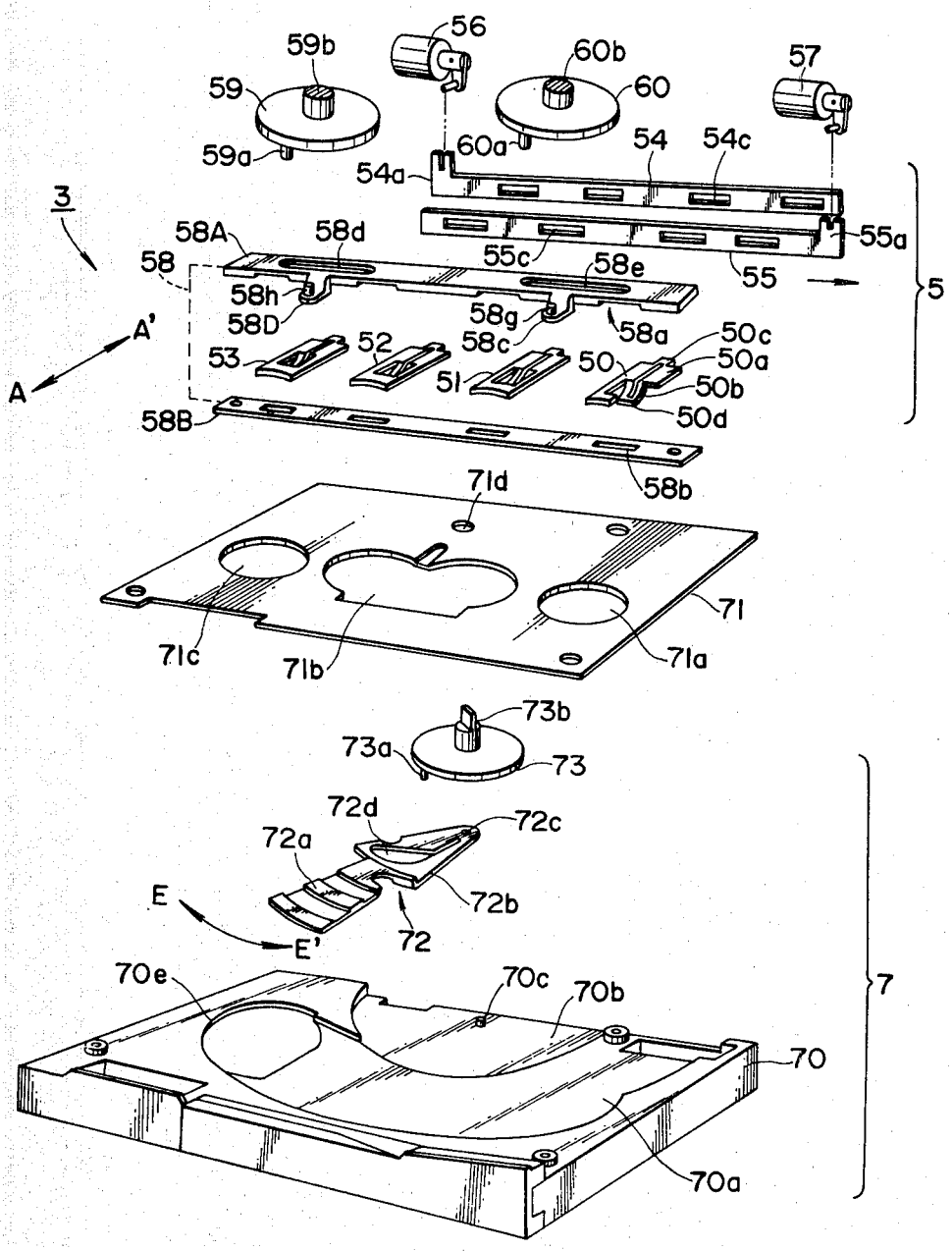
FIG. 7 is an explanatory diagram showing a coin dispensing mechanism in the apparatus according to the invention.
Figure 8:
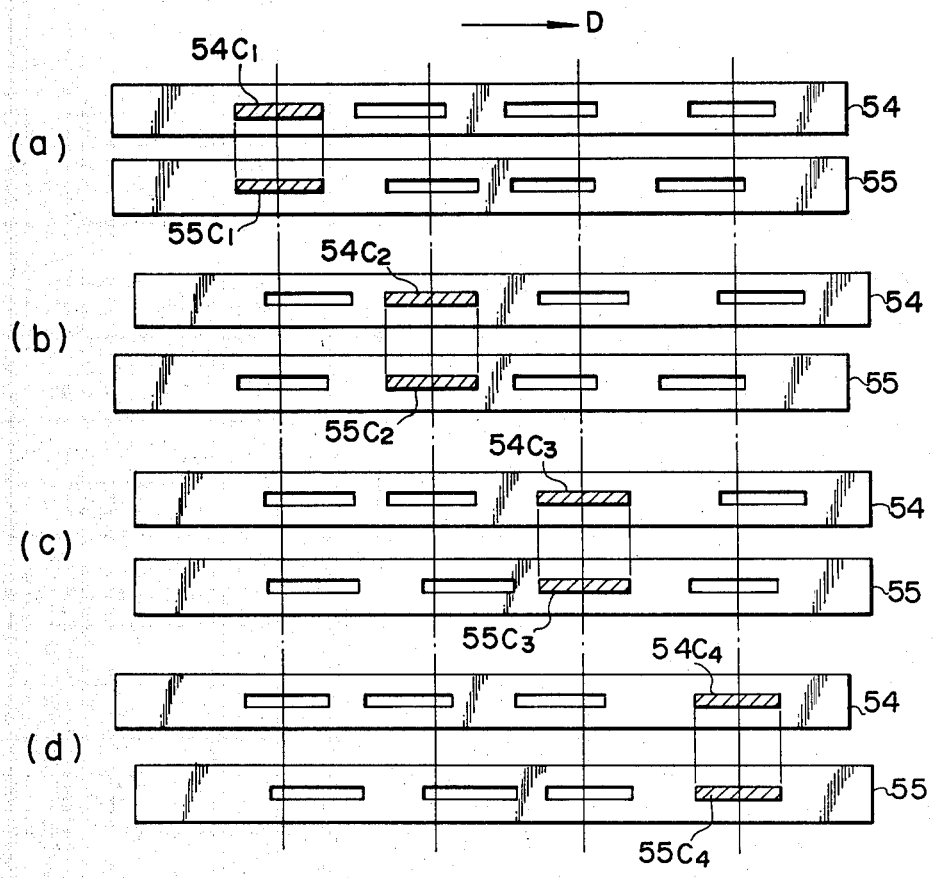
Figure 9:
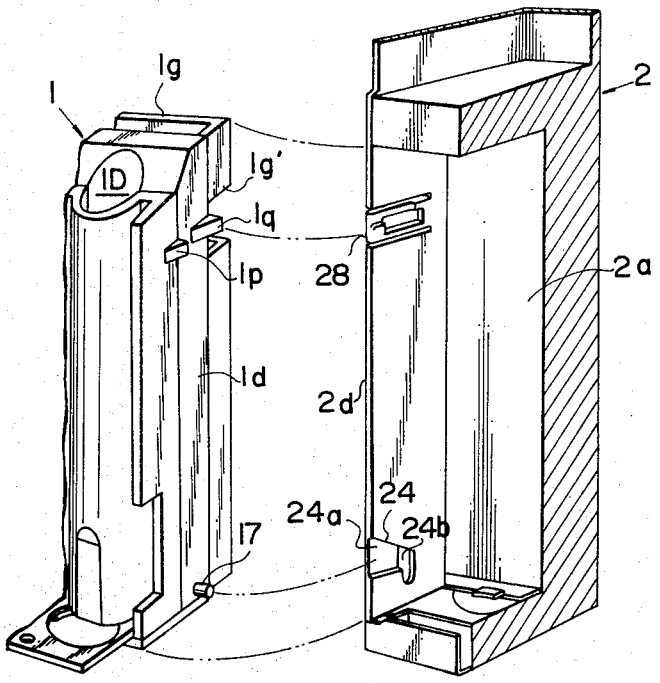
Figure 10:
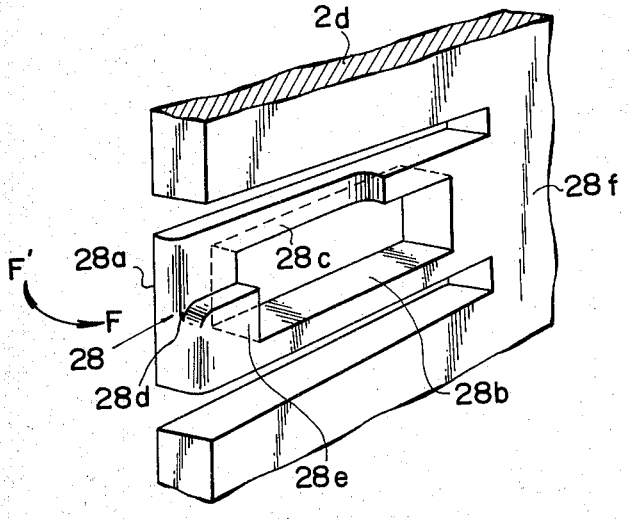

The parts (a) through (d) of FIG. 8 are explanatory diagrams for a description of the operation of change levers shown in FIG. 7;

FIG. 9 is an explanatory diagram showing the essential components of another example of the locking part of the cassette type coin tube assembly, shown in FIG. 2;

FIG. 10 is an enlarged view of the locking part shown in FIG. 9; and

Figure 11:
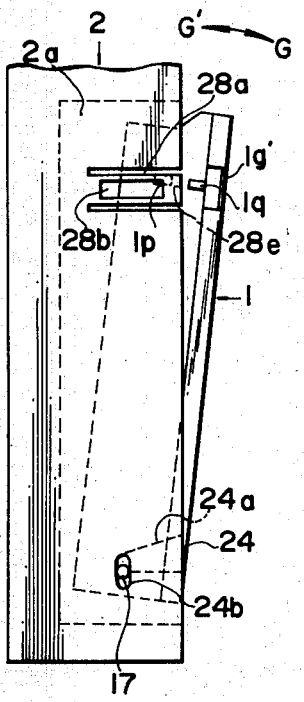
Figure 12:
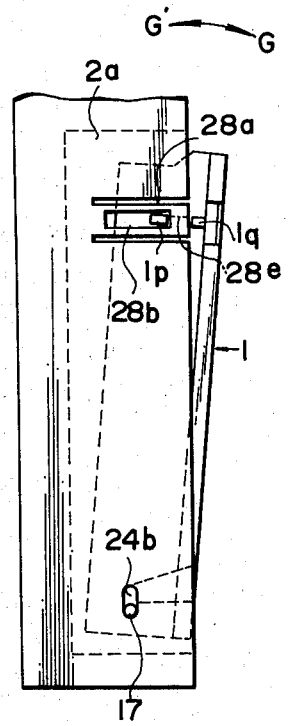
Figure 13:
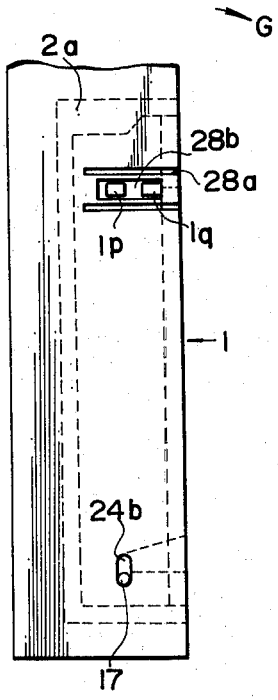

FIGS. 11, 12 and 13 are explanatory diagram for a description of a method of mounting the cassette type coin tube assembly shown in FIG. 9 in the compartment and a method of removing it from the compartment.

DETAILED DESCRIPTION OF THE INVENTION

First, a coin dispensing apparatus according to this invention will be described briefly.

The coin dispensing apparatus comprises: a coin dispensing apparatus body 2 (FIG. 2); a cassette type coin tube assembly 1 (FIG. 1) (hereinafter referred to merely as a "coin tube 1" when applicable) which is detachably loaded on the body 2; and a dispensing coin selection control device (FIG. 7) which is built in the lower portion of the coin dispensing apparatus body 2, for selectively dispensing predetermined coins out of the cassette type coin tube 1.

Figure 1:
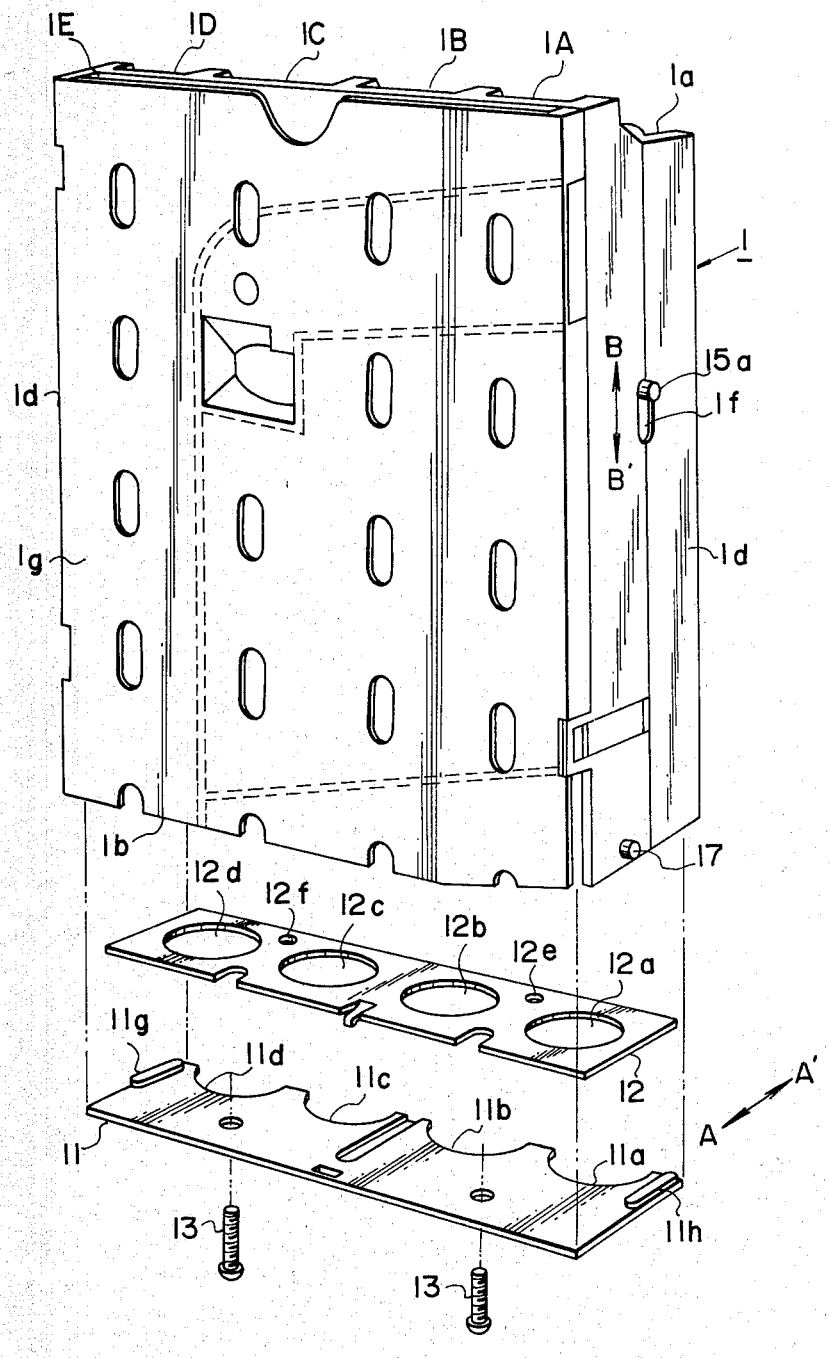
FIG. 1 is an exploded perspective view of a cassette type coin tube assembly in a coin dispensing apparatus according to this invention.

The cassette type coin tube assembly 1, as shown in FIGS. 1 and 2, comprises a plurality of, for instance four, coin tubes 1A, 1B, 1C and 1D which are juxtaposed as one unit. Each of the coin tubes 1A through 1D are open at the upper end (as indicated at 1*a*), and a coin base 11 for supporting loaded coins is fixedly secured to the lower end 1*b* of the coin tubes with screws 13.

The coin base 11 has four cuts 11*a* through 11*d*, so that about two-thirds of the bottom of each coin tube is closed by the coin base 11. It should be noted that the lower open end 1*b* of the coin tubes 1A through 1D is spaced apart from the coin base 11 as much as the thickness of stripes 11*g* and 11*h* on the coin base 11. The thickness of the stripes 11*g* and 11*h* is slightly larger than that of coins. A pay-out slide 12 for pulling out coins is inserted between the gap between the lower open end of the coin tubes 1A through 1D and the coin base 11 in such a manner that is slidable in the directions of the arrows A and A', or forwardly or backwardly. The thickness of the pay-out slide 12 is equal to that of coins. The pay-out slide 12 has through-holes 12*a*, 12*b*, 12*c* and 12*d* corresponding in position to the coin tubes 1A through 1D. The holes 12*a* through 12*d* are adapted to receive the bottom ones of the coins which are stored in the coin tubes 1A through 1D, respectively. When the cassette type coin tube 1 is mounted in the coin tube receiving section 2*a* of the coin dispensing apparatus body 2, the pay-out slide 12 is engaged through holes 12*e* and 12*f* with protrusions 58*g* and 58*h* formed on levers 58C and 58D (FIG. 7) in the dispensing coin selection control device 3. In dispensing the coins, the pay-out slide 12 is slid in the directions A and A' by these levers 58C and 58D, so that the coins in the holes 12*a* through 12*b* are pulled out simultaneously.

Both sides 1*d* and 1*d* of the cassette type coin tube 1 have recesses 1*e* substantially at the central portions, respectively. Vertically elongated slits 1*f* are formed in the recesses 1*e*, respectively. A locking member 15 is engaged with the slit 1*f* in each recess 1*e* in such a manner that it is slidable in the directions of the arrows B and B'. A locking part 15*a* is extended from each locking member 15 in such a manner that it portrudes through the slit 1*f* outside the side 1*d*. The locking parts 15*a* are so dimensioned as to be slidably movable in the respective slits 1*f*. A spring 16 is interposed between the bottom of each recess 1*e* and the bottom of each locking member 15 so that the latter 15 is pushed upwardly to an upper position in the recess 1*e* as shown in FIG. 2, and is locked at the upper end of slit 1*f*. Each locking part 15*a* can be moved to the lower end of the slit 1*f* by pushing it down in the direction of the arrow B'. Locking parts 17 and 17 are protruded from the substantially central portions of the lower halves of the two sides 1*d* and 1*d*. A front cover 1*g* and a front tube 1*h* can be engaged with each other by means of locking parts 1*i* and 1*j*.

The outer surface of a predetermined coin tube, for instance the tube 1C, has a cut 1*m* at a predetermined position in such a manner that the cut 1*m* is extended axially. The cut 1*m* is brought into close contact with the detection surface 80A of a coin level detector 80 described later.

The cassette type coin tube 1 is constructed as described above.

The coin dispensing apparatus body 2 has a tube receiving compartment 2*a* for receiving the cassette type coin tube 1. Both sides 2*d* and 2*d* of the compartment 2*a* have locking slits 21 and 22 at positions corresponding to the locking parts 17 and 17, respectively. The slits 21 and 22 are constituted by guide grooves 21*a* and 22*a* and sloped slit parts 21*b* and 22*b* extended from the guide grooves. Furthermore, slits 23 and 24 are formed in the two sides 2*d* and 2*d*. The slits 23 and 24 are constituted by guide grooves 23*a* and 24*a* and vertical slit parts 23*b* and 24*b*, respectively.

The compartment 2*a* has a partition plate 2*h*, the lower portion of which has a hole 25 at a position corresponding to that of the cut 1*m* of the coin tube 1. The aforementioned empty detector 80 is provided in the hole 25. The empty detector 80 is a circularly wound coil to which a high frequency signal is applied to detect coins in the tube as impedance variations. The empty detector 80 is covered with rubber (not shown). The empty detector 80 is provided with pins 81 (FIG. 5) which are inserted in grooves 25*a* formed in both sides of the hole 25, so that it is supported rotatably (in the directions of the arrows C and C') in the hole 25. The grooves 25*a* are positioned on the horizontal diameter of the hole 25. The rear part 80*b* of the detector 80 is depressed by the spring 83 of a support 82 so that the detector 80 is protruded from the hole and is slightly inclined to face upwardly and that it can go freely in and out of the compartment 2*a*.

The coin tube receiving compartment 2*a* and the empty detector 80 are arranged as described above.

Figure 3:
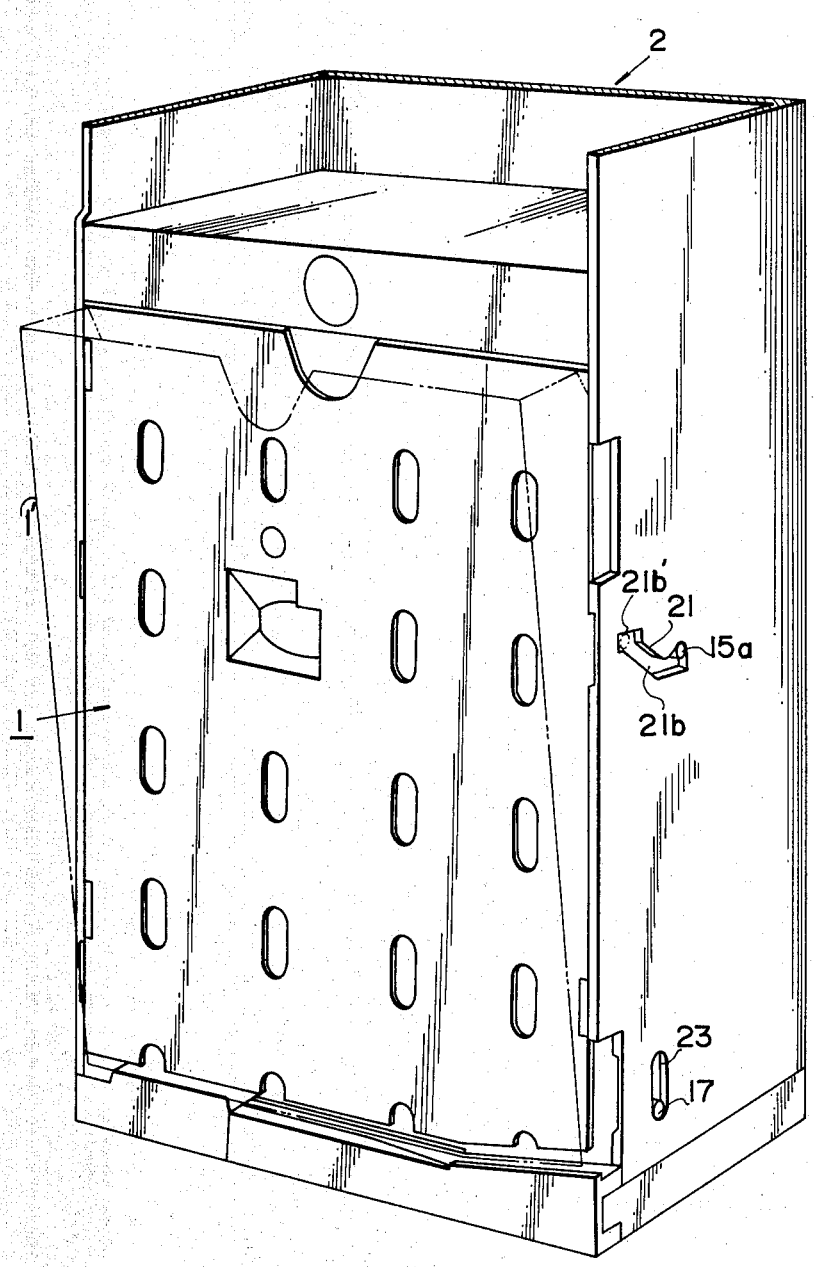
FIG. 3 is an explanatory diagram for a description of a method of mounting the cassette type coin tube assembly in the compartment shown in FIG. 2.
Figure 5:
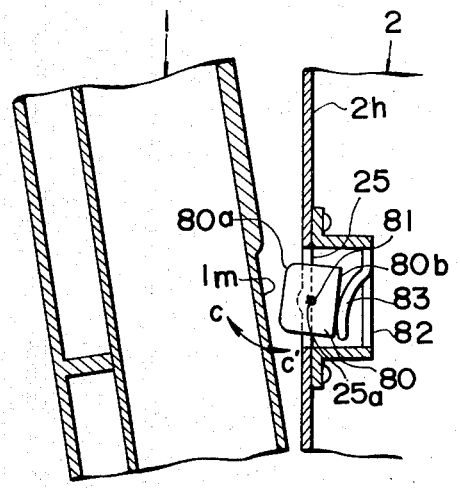
FIGS. 5 and 6 are explanatory diagrams showing the relationships between the coin tube assembly and a coin level detector in the case where the former is mounted in the compartment.

After predetermined coins are put in the coin tubes 1A through 1D of the cassette type coin tube 1, the rear side **1*h* of the coin tube 1 is confronted with the partition plate 2*h* of the compartment 2*a*. Then, the locking parts 17 and 17 formed on the two sides of the coin tube 1 are inserted into the slit parts 23*b* and 24*b* through the guide grooves 23*a* and 24*a* of the slits 23 and 24 on the corresponding two sides of the compartment 2*a*, respectively. Thereafter, the coin tube 1 is turned around these locking parts 17 and 17 by pushing the upper part of the front side 1*g* towards the compartment 2*a*, so that the locking parts 15*a* and 15*a* on the two sides of the coin tube 1 are inserted into the slit parts 21*b* and 22*b* through the guide grooves 21*a* and 22*a* of the slits 21 and 22 on the corresponding two sides of the compartment 2*a*, respectively. Under this condition, the locking parts 15*a* and 15*a* are positively engaged with the front grooves 21*b*' and 22*b*' which are extended from the sloped slit parts 21*b* and 22*b*, by means of the springs 16, respectively, and the coin tube 1 is locked obliquely as indicated by the dotted lines in FIG. 3. Furthermore, under this condition, the positional relationships between the coin level detector 80 and the cut 1*m* of the coin tube 1 are as shown in FIG. 5**.

Figure 4:
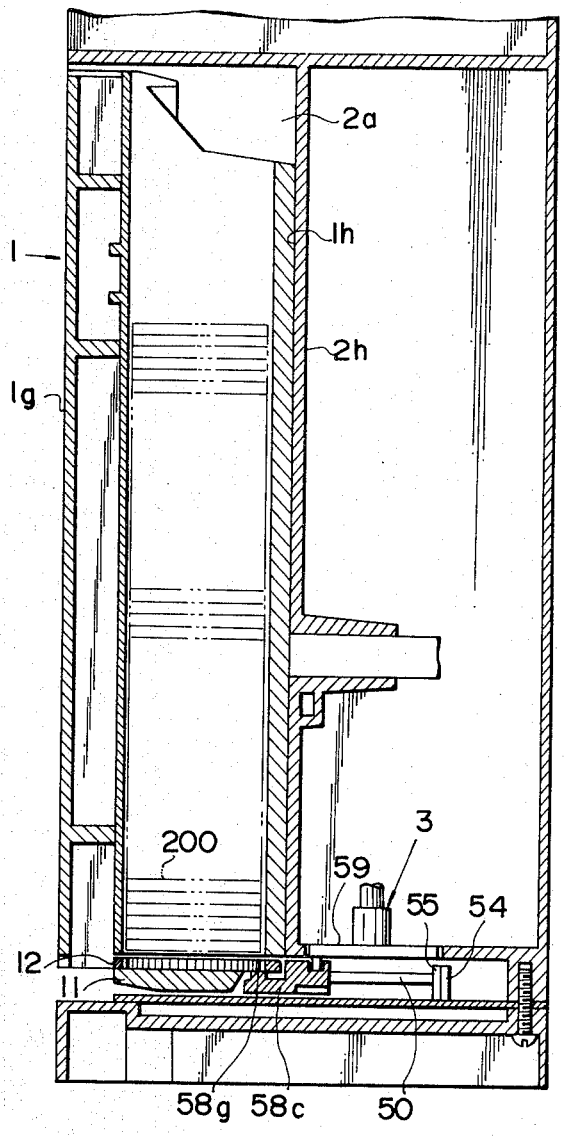
FIG. 4 is a sectional view showing the cassette type coin tube assembly mounted in the compartment.
Figure 6:
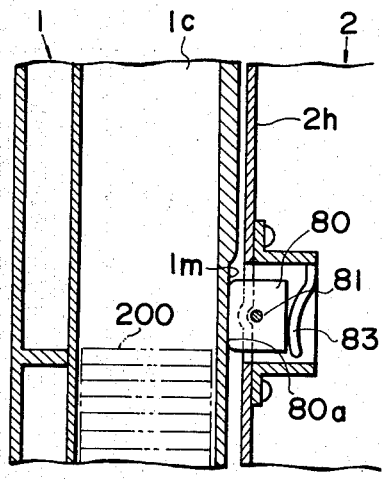

Then, the coin tube 1 is further turned against the elastic force of the locking parts **15*a* and 15*a* by pushing the upper part of the coin tube 1 towards the compartment 2*a*, so that the locking parts 15*a* and 15*a* are engaged with the rear grooves 21*b*'' and 22*b*'' which are formed in the slit parts 21*b* and 22*b*, respectively. As a result, the cassette type coin tube 1 is loaded correctly in the compartment 2*a* as shown in FIG. 4. At the same time, the aforementioned protrusions 58*g* and 58*h* of the levers 58C and 58D are inserted into the corresponding holes 12*e* and 12*f* of the pay-out slide, so that the pay-out slide 12 is coupled to the levers 58C and 58D, as shown in FIG. 4. In this operation, the cut 1*m* of the tube 1C pushes the detection surface 80*a* of the coin level detector 80 in the direction of the arrow C' (FIG. 5) against the elastic force of the spring 83. Accordingly, the detection surface 80*a* of the coin level 80 is elastically brought into close contact with the cut 1*m* of the coin tube 1C. That is, when the coin tube 1 is loaded correctly in the compartment 2*a* as shown in FIG. 4, the detection surface 80*a* of the coin level detector 80 is brought in close contact with the cut 1*m* of the tube 1C (FIG. 6). Accordingly, even if the coin tube 1 could not be fitted snugly in the compartment 2*a* because of their constructions, the detection surface 80*a* would be in close contact with the cut 1*m***.

The coin level detector 80 detects immediately when the total height of the coins 200 (indicated by the chain lines in FIGS. 4 and 6) in the tube 1C becomes smaller than the level of the coin level detector 80, to output a detection signal thereby to operate an coin level switch (not shown), as a result of which an auxiliary tube dispensing device (not shown) is operated to supply a predetermined number of coins into the coin tube 1C.

In the above-described coin dispensing apparatus, only one coin level detector is provided; however, the invention is not limited thereto or thereby. That is, the empty detector may be provided for each of the tubes. In the case where all the tubes are not provided with the coin level detectors, the unnecessary coin level detector mounting holes 26 in the partition plate **2*h* should be covered with blind plates 27 so as to protect the interior of the compartment 2*a*** from dust.

The dispensing coin selection control device 3 (FIG. 7) is provided in the lower part of the coin dispensing apparatus body 2. The device 3 comprises: a coin selection control section 5; and a coin dispensing mechanism 7, as shown in FIG. 7.

The coin selection control section 5 is made up of: change slides 50, 51, 52, and 53; change levers 54 and 55; and solenoids 56 and 57. The change slides 50 through 53 are adapted to temporarily support the coins in the holes **12*a* through 12*d* of the pay-out slide 12, respectively. The body 50*a* of the change slide 50 has a tongue 50*b* which is obtained by punching its three sides. The body 50*a* has a locking part 50*c* at one end. A slider 58 (FIG. 6) is obtained by bringing slide members 58A and 58B together. In this case, a hole 58*a* is formed in the slider 58. The body 50*a* of the change slide 50 is so dimentioned that it can go through the hole 58*a* of the slider 58 with a small gap therebetween. The tongue 50*b* is thinner than the body 50*a*, and has a protruded strip 50*d* at the end. The protruded strip 50*d* is protruded below the bottom of the body 50*a* so that it is engaged with a groove b in the slider 58. The change slide 50 is made of synthetic resin, so that the tongue is deformed by depressing the protruded strip 50*d*, but it is restored by removing the depressing force. The other change slides 51 through 53 are the same in construction as the change slide 50** described above.

The change slides 50 through 53 are inserted into the holes **58*a* of the slider, respectively. Their protruded strips 50*d* through 53*d* are fitted in the grooves 58*b*. Thus, the change slides are moved with the slider 58**.

A disc-shaped cam 59 has a protrusion **59*a* at the periphery of its bottom. The protrusion 59*a* is movable along a groove 58*d* of the slider 58 with a slight gap therebetween. A cam 60 is completely the same in construction as the cam 59. These cams 59 and 50 are coupled respectively through shafts 59*b* and 60*b* to a gear box (not shown). The cams 59 and 60 are synchronously turned in the opposite directions by a driving motor (not shown) to move the slider 58** in the directions of the arrows A and A'.

The change levers 54 and 55 are provided to control the follow movement of the change slides 50 through 53. First end portions **54*a* and 55*a* of the change levers 54 and 55 are bent at right angles as shown in FIG. 7. The change levers 54 and 55 have holes 54*c*1 through 54*c*4 and holes 55*c*1 through 55*c*4 at predetermined positions as shown in FIG. 8. These holes 54*c*1 through 55*c*4 are the same in size as the holes 58*a* in the slider 58. The locking parts 50*c* through 53*c* of the change slides 50 through 53 are inserted into the holes 54*c*1 through 54*c*4 and 55*c*1 through 54*c*4 of the change levers 54 and 55. These change levers 54 and 55 are arranged on a bottom plate 71 (FIG. 7), so that the bent portions 54*a* and 55*a* of the change levers 54 and 55 are coupled to the solenoids 56 and 57, respectively. The solenoids 56 and 57 operate to move the change levers 54 and 55** in the direction of the arrow D.

The coin dispensing mechanism 7 comprises: a bottom base 70; the aforementioned bottom plate 71; and a wiper 72. The bottom base 70 is the base part of the dispensing coin selection control device 3. The upper surface of the bottom base 70 includes recessed surfaces **70*a* and 70*b* as shown in FIG. 7. The recessed surface 70*a* has a coin dispensing outlet 70*e* at one end, while the recessed surface 70*b* has a supporting shaft 70*c* at a predetermined position, which is used to rotatably support the wiper 72**.

The wiper 72 operates to bring a coin falling on the recessed surface 70*a* of the bottom base 70 to the coin dispensing outlet 70*e*. The wiper 72 has a hole 72*c* through which the wiper 72 is rotatably supported by the aforementioned supporting shaft. The wiper 72 is so designed that its upper and lower portions 72*a* and 72*b* slide on the recessed surfaces 70*a* and 70*b*, respectively.

The wiper 72 is provided with a cam 73 which is adapted to control the rotation of the wiper 72. The cam 73 has a protrusion 73*a* at the periphery of the bottom, which is inserted into a hole 72*d* formed in the lower portion 72*b* of the wiper 72. The cam shaft 73*b* is coupled to the aforementioned gear box through a holes 71*d* in the bottom plate 71, so that the cam is turned with predetermined timing.

The bottom plate 71 is the same in size as the bottom base 70. The bottom plate 71 has holes 71*a* through 71*c* substantially at the central region in correspondence to the holes 12*a* through 12*d* of the pay-out slide 12. More specifically, these holes 71*a* through 71*c* are above the recessed surface 70*a* of the bottom base 70.

The bottom plate 71 is fixedly placed on the bottom base 70, and then the slider 58 and the change levers 54 and 55 are arranged on the bottom plate 71. The change slides 50 through 53 are inserted into the holes 58*a* of the slider 58, respectively, and the locking parts 50*c* through 53*c* of the change slides 50 through 53 are inserted in the respective holes 54*c* and 55*c* of the change levers 54 and 55. Then, the protrusions 59*a* and 60*a* of the cams 59 and 60 are inserted into the holes 58*d* and 58*e* of the slider 58.

The dispensing coin selection control device 3 has been constructed as described above.

The operation of the dispensing coin selection control device 3 has been disclosed in the specification of the previous patent application (U.S. patent application No. 952,817 filed Oct. 19, 1978 and has issued as U.S. Pat. No. 4,250,905) in detail, and therefore it will be briefly described here.

It is assumed that, as a coin dispensing operation is started, the cams 59 and 60 starts turning clockwise and counterclockwise respectively and that the solenoids 56 and 57 are not energized yet and the change levers are positioned as shown in the part (a) of FIG. 8. The slide 58 is slid on the bottom plate 71 in the direction of the arrow A' as the cams 59 and 60 turn. As the change slides 50 through 53 are locked in the holes 58*a* of the slide 58, they tend to follow the movement of the slide 58.

However, in this case, only the holes 54*c*1 and 55*c*1 coincide correctly with each other in the change levers 54 and 55, and accordingly only the change slide 50 can go through the holes 54*c*1 and 55*c*1 of the change levers 54 and 55. Accordingly, the change slide 50 is moved in the direction of the arrow A' following the slider 58. On the other hand, the remaining change slides 51 through 53 cannot go through the holes of the change levers 54 and 54; that is, the movement of these change slides is inhibited by the change levers 54 and 55. As the slider 58 moves in the direction of the arrow A', the protruded strips of the tongues 51*b* through 53*b* of these change slides 51 through 53 are moved upwardly to be disengaged with the engaging grooves 58*b*, respectively, so that the change slides 51 through 53 are released from the slider 58. Thus, the change slides 51 through 53 are held at the initial positions.

The bottom coins in the coin tubes 1A through 1D are in the holes 12*a* through 12*d* of the pay-out slide 12, and accordingly are moved out of the coin tubes 1A through 1D with the movement of the pay-out slide 12. As the pay-out slide 12 is moved in the direction of the arrow A', the coin in the coin tube 1A is caused to fall from the coin base 11 through the hole 71*c* of the bottom plate 71 onto the upper surface 70*a* of the bottom base 70, while the coins in the other coin tubes 1B through 1D are moved onto the change slides 51 through 53 and are allowed to slide on these change slides 51 through 53, respectively.

When the cams 59 and 60 have turned through exactly 180° C., the pay-out slide 12 is at its furthest position, in the direction of the arrow A'. Under this condition, the coin which was in the tube 1A is on the bottom base upper surface 70*a*, while the coins which were in the tubes 1B through 1D are on the change slides 51 through 53, and the remaining coins in the tubes 1A through 1D are on the flate plate portion of the pay-out slide 12.

As the wiper 72 is turned in the direction of the arrow E in FIG. 7 by the cam 73, the coin on the upper surface 70*a* of the bottom base 70 is caused to drop through the hole 70*e*.

As the cams 59 and 60 are further turned, the pay-out slide 12 is driven in the direction of the arrow A. Accordingly, following the slider 58, the change slide 50 is moved in the direction of the arrow A. On the other hand, following the pay-out slide 12, the coins on the change slides 51 through 53 are slidably moved in the direction of the arrow A from the change slides 51 through 53 onto the coin base 11.

When the cams 59 and 60 has made one revolution, the pay-out slide 12 is at the original position. Accordingly, one coin is allowed to fall into the hole 12*a* of the pay-out slide 12 from the tube 1A. The coins on the coin base 11 are pushed back to position under the stacks of coins in the tubes 1B through 1D, respectively, and the protruded strips of the tongues of the change slides 51 through 53 are dropped into the respectively grooves 58*b*; that is, they are locked by the slider 58 again.

In the case where the solenoid 56 is energized at the start of a coin dispensing operation (FIG. 8, (b)), only the change slide 51 is allowed to follow the pay-out slide 12. Similarly as in the above-described case, the coin in the hole 12*b* is dispensed. When both the solenoids 56 and 57 are energized (FIG. 8, (c)), the coin in the hole 12*c* is dispensed. When only the 57 is energized (FIG. 8, (d)), the coin in the hole 12*d* is dispensed. The solenoids 56 and 57 are maintained energized until at least one dispensing operation is accomplished after the start of the dispensing operation.

In a manner as described above, a predetermined number of coins are dispensed one at a time through the respective holes separately according to the denominations thereof.

FIG. 9 shows another example of the locking means which is formed on the side walls of the cassette type coin tube 1 and of the coin tube recieving compartment 2*a*.

As shown in FIG. 9, substantially wedge-shaped pawls 1*p* and 1*q* are juxtaposed at predetermined positions on the upper portion of one side wall 1*d* of a cassette type coin tube 1 in such a manner that they are protruded from the side wall 1*d* and are spaced a predetermined value from each other. The amount of protrusion of the pawl 1*q* is larger than the amount of protrusion of the pawl 1*p*. The above-described locking parts 17 are formed at predetermined positions on the lower portions of the two side walls 1*d* of the coin tube 1. A cut 1*q*′ is formed in the front cover 1*g* so that the coin tube 1 can be readily held with the hand. The remaining parts of the coin tube 1 are completely equal to those of the coin tube 1 shown in FIG. 1.

The side wall 2*d* of the coin dispensing apparatus body 2 has a locking part 28 at a position corresponding to that of the pawls 1*p* and 1*q*. The locking part 28, as shown in FIG. 10, has a substantially tongue-shaped locking piece 28*a* in which a rectangular groove 28*b* is formed. The upper edge 28*c* and the front edge 28*e* of the groove 28*b* are smaller in thickness over predetermined distances than the body of the locking part 28. The wall 2*d* of the apparatus body 2 is integrally made of synthetic resin, so that the locking part can swing (or rock) inwardly and outwardly (or in the directions of the arrows F and F′) with its base as the fulcrum, i.e. the locking part can make a snap action.

In mounting the cassette type coin tube 1 in the compartment 2*a* of the coin dispensing apparatus body 2, first the locking parts 17 on the two side wall 1*d* of the coin tube 1 are inserted through the guide grooves 24*a* of the slits 24 into the slit parts 24*b* (FIG. 11). Then, the coin tube 1 is slightly raised, and the upper portion of the coin tube 1 is depressed in the direction of the arrow G′ while the pawl 1*p* is slide along the thin wall portion of the locking part 28. Accordingly, the coin tube 1 is turned around the locking parts 17, so that the pawl 1*p* enters the groove 28*b*. Under this condition, even if the coin tube 1 is un handed, the coin tube 1 is positively held by the side wall 1*d*. As the coin tube 1 is further depressed in the direction of the arrow G′, the coin tube 1 is turned. Accordingly, the pawl 1*q* is fitted in the groove 28*b* while the locking piece 28*a* is being bent outwardly (or in the direction of the arrow F′ in FIG. 10) (FIG. 13). After the pawls 1*q* has been fitted in the groove 28*b*, the locking piece 28*a* is restored by its own elastic force, and the end face of the pawl 1*q* is locked in abutment with the side of the groove 28*b*, so that the coin tube 1 cannot be moved in the direction of the arrow G. Thus, the coin tube 1 has been mounted and locked in the compartment 2*a* of the dispensing apparatus body 2.

The coin tube 1 can be removed from the dispensing apparatus body 2 by reversing the above-described coin tube mounting steps. With the locking piece 28*a* bent outwardly with the hand, the upper portion of the coin tube 1 is pulled forwardly (or in the direction of the arrow G) to cause the pawl 1*q* to disengage from the groove 28*b*. After this, the locking piece 28*a* is unhanded, as a result of which, as was described before, the locking piece 28*a* is restored, and the pawl 1*p* is locked by the edge of the groove 28*b* (FIG. 12). Under this condition, about a half of the upper portion of the coin tube 1 is outside the dispensing apparatus body 2, so that coins can be supplied into the tubes 1A through 1D. With the coin tube 1 raised, the pawl 1*p* is pulled out of the groove 28*b*, and then the locking parts 17 and 17 are pulled out of the slits 23 and 24, respectively. Thus, the coin tube 1 has been removed from the apparatus body 2.

In the above-described example, the pawls 1*p* and 1*q* and the locking part 28 are provided on one side of the coin dispensing apparatus; however, it should be noted that the invention is not limited thereto or thereby; that is, the pawls and the locking part 28 may be provided on each side of the apparatus.

What is claimed is:

1. A coin dispensing apparatus comprising:

a coin tube assembly made up of a plurality of coin tubes which are juxtaposed as one unit;

a housing in which said coin tube assembly is detachably mounted;

a pay-out slide having holes for receiving and holding the bottom coins in said coin tubes;

a coin base provided below aid pay-out slide, for supporting the coins in said coin tubes; and dispensing coin selection control means for causing only a predetermined one of the coins which have been taken out by said pay-out slide to drop and the remaining ones to return to positions below the stacks of coins in said coin tubes, respectively.

2. A coin dispensing apparatus comprising:

a coin tube assembly made up of a plurality of coin tubes;

a housing in which said coin tube assembly is detachably mounted, said housing having a hole provided at a position corresponding to that of a lower portion of at least one coin tube;

a coin level detector which is provided in said hole, for detecting when the number of coins in said one coin tube reaches a predetermined value; and spring means for pressing said coin level detector against the exterior of the lower portion of said one coin tube of said coin tube assembly when said coin tube assembly is fitted in said housing.

3. A coin dispensing apparatus comprising:

a housing at least one side wall of which has first and second locking parts on the upper and lower portions thereof, said first locking part comprising an elastic locking piece which has a groove formed in the central portion of said locking piece and a relatively thin portion above said groove; and a coin tube assembly having a side wall which has a substantially wedge-shaped pawl member at a position corresponding to said first locking part and a protrusion at a position corresponding to said second locking part so that said pawl member and said protrusion are engaged with said first and second locking parts, respectively.

4. A coin dispensing apparatus comprising:

a housing at least one side wall of which has first and second locking parts on the upper and lower portions thereof; and a coin tube assembly having a side wall which has a substantially wedge-shaped pawl member at a position corresponding to said first locking part and a protrusion at a position corresponding to said second locking part so that said pawl member and said protrusion are engaged with said first and second locking parts, respectively, said pawl member comprising first and second pawls, said first pawl being smaller in height than said second pawl, whereby when only said first pawl is engaged with said first locking part on said housing, the upper portion of said coin tube assembly is outside of said housing so that coins can be supplied into said coin tube asssembly.

5. A coin dispensing apparatus comprising:

a housing at least one side wall of which has first and second groves on the upper and lower portions thereof; and a coin tube assembly having a side wall which has a substantially wedge-shaped protrusion member at a position corresponding to said first groove and a second protrusion member at a position corresponding to said second groove so that said wedge-shaped protrusion member and said second protrusion member are engaged with said first and second grooves, respectively, when the coin tube assembly is locked in the housing.

6. The apparatus of claim 5 wherein said housing side wall has an elastic tab on the upper portion thereof and said first groove is formed in the elastic tab.

7. The apparatus of claim 5 wherein the coin tube assembly is pivotable about the second protrusion member when engaged with the second groove and the coin tube assembly side wall further has a second wedge-shaped protrusion member at a position corresponding to said first groove so that said second wedge-shaped protrusion member is engaged with the first groove when the coin tube assembly is pivoted outward so that coins can be supplied to the coin tube assembly locked in the outward position.

8. A coin dispensing apparatus comprising:

a coin tube assembly having a plurality of coin tubes for holding coins;

a housing in which said coin tube assembly is detachably mounted;

a coin level detector having a detector surface for detecting when the number of coins in said one coin tube reaches a predetermined value; and spring means for resiliently mounting said detector to said housing so that said detector surface is urged against the exterior of at least one of said coin tubes when said coin tube assembly is fitted in said housing.

9. The apparatus of claim 8 wherein said one coin tube has an exterior wall of reduced thickness against which the coin level detector surface is urged to bring the coin level detector surface is closer physical proximity to the interior of said one coin tube.

* * * * *